US010533349B2

(12) United States Patent
Suzumura et al.

(10) Patent No.: US 10,533,349 B2
(45) Date of Patent: Jan. 14, 2020

(54) DOOR LOCK DEVICE FOR VEHICLE

(71) Applicant: AISIN SEIKI KABUSHIKI KAISHA, Kariya-shi, Aichi (JP)

(72) Inventors: Makoto Suzumura, Chita (JP); Takashi Nishio, Kariya (JP); Nobuko Takasu, Takahama (JP); Yasuhiko Sono, Hekinan (JP); Masayuki Tomochika, Anjo (JP); Masanari Iwata, Ichinomiya (JP); Yusuke Yamada, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 717 days.

(21) Appl. No.: 14/438,663

(22) PCT Filed: Sep. 27, 2013

(86) PCT No.: PCT/JP2013/076247

§ 371 (c)(1),
(2) Date: Apr. 27, 2015

(87) PCT Pub. No.: WO2014/069130

PCT Pub. Date: May 8, 2014

(65) Prior Publication Data

US 2015/0300051 A1 Oct. 22, 2015

(30) Foreign Application Priority Data

Oct. 29, 2012 (JP) ..... 2012-238246
Oct. 29, 2012 (JP) ..... 2012-238247

(51) Int. Cl.
*E05B 79/10* (2014.01)
*E05B 79/16* (2014.01)
(Continued)

(52) U.S. Cl.
CPC ..... *E05B 79/10* (2013.01); *E05B 79/12* (2013.01); *E05B 79/16* (2013.01); *E05B 81/06* (2013.01);
(Continued)

(58) Field of Classification Search
CPC ..... E05B 79/10; E05B 79/12; E05B 79/16; E05B 81/06; E05B 81/16; Y10T 292/108;
(Continued)

(56) References Cited

U.S. PATENT DOCUMENTS 6,116,807 A 9/2000 Dzurko et al.
6,568,722 B2 * 5/2003 Raffelsiefer ..... E05B 77/245 292/201
(Continued)

FOREIGN PATENT DOCUMENTS

DE 10 2010 015 058 A1 10/2011
EP 0679783 A1 11/1995
(Continued)

OTHER PUBLICATIONS

International Search Report (PCT/ISA/210) dated Dec. 17, 2013, by the Japanese Patent Office as the International Searching Authority for International Application No. PCT/JP2013/076247.
(Continued)

*Primary Examiner* — Kristina R Fulton
*Assistant Examiner* — Faria F Ahmad
(74) *Attorney, Agent, or Firm* — Buchanan Ingersoll & Rooney PC

(57) ABSTRACT

A vehicle door lock device includes: a door lock body configured to be mounted to a door; an outside open lever mounted, in a pivotable manner, to a support shaft arranged on the door lock body; and a coupling member mounted to a pivot end portion of the outside open lever and having an insertion hole. An end portion of a rod on the outside open
(Continued)

lever side is insertable through the insertion hole. The rod is configured to couple the outside open lever and an outside door handle configured to be mounted to a vehicle exterior side of the door. A mounting hole in the coupling member intersects the insertion hole, and the pivot end portion of the outside open lever has a mounting portion. The coupling member is fitted and fixed onto the mounting portion of the outside open lever through the mounting hole.

8 Claims, 9 Drawing Sheets

(51) Int. Cl.
*E05B 79/12* (2014.01)
*E05B 81/06* (2014.01)
*E05B 81/16* (2014.01)

(52) U.S. Cl.
CPC ..... *E05B 81/16* (2013.01); *Y10T 292/108* (2015.04); *Y10T 292/1047* (2015.04); *Y10T 292/1082* (2015.04); *Y10T 292/1092* (2015.04)

(58) Field of Classification Search
CPC ..... Y10T 292/1082; Y10T 292/1092; Y10T 292/1047
USPC ..... 292/200, 210, 216
See application file for complete search history.

(56) References Cited

U.S. PATENT DOCUMENTS 6,609,737 B2 * 8/2003 Fisher ..... E05B 81/06 292/201
6,733,052 B2 * 5/2004 Perkins ..... E05B 81/06 267/153
7,125,057 B2 * 10/2006 Coleman ..... E05B 77/26 292/201
7,293,806 B2 * 11/2007 Umino ..... E05B 77/54 292/201
7,648,192 B2 * 1/2010 Herline ..... E05B 77/04 292/92
8,360,486 B2 * 1/2013 Gschweng ..... E05B 17/0062 292/336.3
8,814,226 B2 8/2014 Akizuki et al.
8,840,154 B2 * 9/2014 Wilms ..... E05B 81/06 292/201
8,955,257 B2 * 2/2015 Moriya ..... B60J 5/0425 296/146.1
9,677,303 B2 * 6/2017 Hirosawa ..... E05B 79/12
2002/0056996 A1 * 5/2002 Fukunaga ..... E05B 85/02 292/216
2003/0173796 A1 * 9/2003 Harima ..... B60J 5/101 296/146.7
2004/0251693 A1 * 12/2004 Schoen ..... E05B 77/06 292/1
2007/0029835 A1 * 2/2007 Herline ..... E05B 77/04 296/146.1
2010/0236300 A1 * 9/2010 Wilms ..... E05B 81/06 70/91
2011/0258935 A1 * 10/2011 Heller ..... B60J 5/0451 49/502
2012/0036785 A1 * 2/2012 Bedekar ..... E05B 77/04 49/394
2012/0119520 A1 5/2012 Akizuki et al.
2016/0215531 A1 * 7/2016 Hirosawa ..... E05B 79/12

FOREIGN PATENT DOCUMENTS

EP 2460960 A1 6/2012
GB 1195769 A 6/1970
JP 6-50043 A 2/1994
JP 2011-26867 A 2/2011

OTHER PUBLICATIONS

Written Opinion (PCT/ISA/237) dated Dec. 17, 2013, by the Japanese Patent Office as the International Searching Authority for International Application No. PCT/JP2013/076247.
The extended European Search Report dated May 17, 2016 by the European Patent Office in corresponding European Patent Application No. 13850191.1-1603 (8 pgs).

* cited by examiner

DOOR LOCK DEVICE FOR VEHICLE

TECHNICAL FIELD

The present invention relates to a vehicle door lock device to be mounted to a door of a vehicle.

BACKGROUND ART

As a vehicle door lock device, there is a vehicle door lock device disclosed in, for example, Patent Literature 1. This vehicle door lock device includes:

a door lock body configured to be mounted to a door of a vehicle (including, for example, a housing, and a latch mechanism, a lever mechanism, a link mechanism, and an electric actuator, which are assembled to the housing);

an outside open lever mounted, in a pivotable (tiltable) manner, to a support shaft arranged on the door lock body; and a coupling member (clip) mounted to a pivot end portion of the outside open lever, the coupling member having an insertion hole through which an end portion of a rod on the outside open lever side is insertable, the rod being configured to couple the outside open lever and an outside door handle configured to be mounted to a vehicle exterior side of the door.

Note that, the end portion of the rod on the outside open lever side (that is also an end portion on the coupling member side) is generally formed into a crank shape, and hence motion (up-and-down motion) of the rod is transmitted to the outside open lever via the coupling member.

CITATION LIST

Patent Literature

[PTL 1] JP 2011-26867 A

In the above-mentioned vehicle door lock device disclosed in Patent Literature 1, a mounting portion formed on the coupling member (cylindrical mounting portion formed coaxially with the insertion hole) is fitted into a mounting hole formed in the outside open lever (mounting hole formed so as to penetrate a tongue-like mounting portion formed at the pivot end portion of the outside open lever (generally formed of an iron plate)) in a thickness direction, to thereby mount the coupling member to the outside open lever. Further, the mounting portion formed on the coupling member has a locking claw (protrusion) to be fitted into and engaged with the mounting hole of the outside open lever, to thereby exert a slip-off preventing function. The locking claw is formed so as to protrude in a radial direction of the insertion hole that is coaxial with the mounting hole of the outside open lever.

SUMMARY OF INVENTION

Technical Problem

Incidentally, in the above-mentioned vehicle door lock device disclosed in Patent Literature 1, the direction of mounting the coupling member to the outside open lever is identical with the direction of inserting (introducing) the rod through the insertion hole of the coupling member. Further, to facilitate the mounting of the coupling member to the outside open lever, the engagement force of the locking claw to be engaged with the mounting hole of the outside open lever is set small. Therefore, under a state in which the coupling member is mounted to the outside open lever, when the rod is inserted through the insertion hole of the coupling member and an end portion of the coupling member is pressed by the rod in the radial direction of the insertion hole, the locking claw may be disengaged so that the coupling member is detached from the outside open lever.

Note that, the above-mentioned problem may be solved by setting a greater engagement force for the locking claw to be engaged with the mounting hole of the outside open lever (setting a greater engagement force for the locking claw at the fitting portion in the thickness direction). At the fitting portion in the thickness direction, however, the length that may be secured for a deflection portion of the locking claw is as small as a length corresponding to the thickness. Therefore, in this case, it is difficult to mount the coupling member to the outside open lever, with the result that the mountability is degraded. Thus, it is difficult to secure both of a necessary and sufficient retention force (engagement force) for the coupling member to be mounted to the outside open lever and satisfactory mountability for the coupling member to be mounted to the outside open lever.

Solution to Problem

The present invention has been made in view of the above-mentioned circumstances, and has a feature in a vehicle door lock device, including:

a door lock body configured to be mounted to a door of a vehicle;

an outside open lever mounted, in a pivotable manner, to a support shaft arranged on the door lock body;

a coupling member mounted to a pivot end portion of the outside open lever, the coupling member having an insertion hole through which an end portion of a rod on the outside open lever side is insertable, the rod being configured to couple the outside open lever and an outside door handle configured to be mounted to a vehicle exterior side of the door;

a mounting hole formed in the coupling member so as to intersect the insertion hole; and a mounting portion formed at the pivot end portion of the outside open lever, the coupling member being fitted and fixed onto the mounting portion of the outside open lever through the mounting hole.

In this case, the vehicle door lock device may further include a first protrusion (**53*c*2) formed on an inner wall of the mounting hole and configured to be engaged with the mounting portion of the outside open lever without a gap. Further, the vehicle door lock device may further include a second protrusion (53*c*1) formed on the coupling member so as to correspond to the mounting hole, and the second protrusion (53*c*1) may be configured to allow fitting between the mounting hole of the coupling member and the mounting portion of the outside open lever in one direction, and to restrict fitting between the mounting hole of the coupling member and the mounting portion of the outside open lever in another direction. The above-mentioned second protrusion (53*c*1**) may include a gentle slope portion and a steep slope portion, and the fitting may be allowed when the gentle slope portion and the mounting portion are brought into abutment against each other, whereas the fitting may be restricted when the steep slope portion and the mounting portion are brought into abutment against each other.

Further, the present invention has another feature in a vehicle door lock device, including:

a door lock body configured to be mounted to a door of a vehicle;

an outside open lever mounted, in a pivotable manner, to a support shaft arranged on the door lock body;

a coupling member being mounted to a pivot end portion of the outside open lever and having an insertion hole;

an outside door handle configured to be mounted to a vehicle exterior side of the door;

a rod being coupled to each of the coupling member and the outside door handle and having an end portion on the coupling member side inserted through the insertion hole;

a mounting hole formed in the coupling member so as to intersect the insertion hole; and a mounting portion formed at the pivot end portion of the outside open lever, the coupling member being fitted and fixed onto the mounting portion of the outside open lever through the mounting hole.

Advantageous Effects of Invention

In the vehicle door lock device according to one embodiment of the present invention, the mounting hole intersecting (for example, orthogonal to) the insertion hole is formed in the coupling member, and the mounting portion is formed at the pivot end portion of the outside open lever. The coupling member is fitted and fixed onto the mounting portion of the outside open lever through the mounting hole. Therefore, the direction of mounting (fitting) the coupling member to the outside open lever is caused to intersect (for example, perpendicular to) the direction of inserting (introducing) the rod through the insertion hole of the coupling member.

Thus, the protrusion (53*c*1) formed on the coupling member (protrusion configured to exert a slip-off preventing function) protrudes in an axial direction of the insertion hole of the coupling member. Therefore, under a state in which the coupling member is mounted to the outside open lever, even when the rod is inserted through the insertion hole of the coupling member and an end portion of the coupling member is pressed by the rod in a radial direction of the insertion hole, the protrusion (53*c*1) is not easily disengaged, with the result that the coupling member is not easily detached from the outside open lever.

Further, in the present invention, the amount of fitting between the mounting portion of the outside open lever (formed into, for example, a tongue shape whose length may be set as appropriate) and the mounting hole of the coupling member is secured sufficiently, thereby being capable of securing a sufficient length for a deflection portion at the protrusion (53*c*1) formed on the coupling member. Thus, the mountability for the coupling member to be mounted to the outside open lever can be attained satisfactorily. Accordingly, it is possible to secure both of a necessary and sufficient retention force (engagement force) for the coupling member to be mounted to the outside open lever and satisfactory mountability for the coupling member to be mounted to the outside open lever.

When the first protrusion (53*c*2) configured to be engaged with the mounting portion of the outside open lever without a gap is formed on the inner wall of the mounting hole for carrying out the present invention as described above, the gap generated between the mounting portion of the outside open lever and the mounting hole of the coupling member can be eliminated by the protrusion (53*c*2), thereby being capable of eliminating looseness of the coupling member from the outside open lever.

Further, when the second protrusion (53*c*1) is formed on the coupling member so as to correspond to the mounting hole for carrying out the present invention as described above, to thereby allow the fitting between the mounting hole of the coupling member and the mounting portion of the outside open lever in one direction, and to restrict the fitting between the mounting hole of the coupling member and the mounting portion of the outside open lever in another direction, the second protrusion (53*c*1) is capable of functioning to prevent the coupling member from being slipped off, and also to prevent the coupling member from being mounted erroneously. Those advantageous effects may be attained similarly when the above-mentioned second protrusion (53*c*1) includes the gentle slope portion and the steep slope portion, and the fitting is allowed when the gentle slope portion and the mounting portion are brought into abutment against each other, whereas the fitting is restricted when the steep slope portion and the mounting portion are brought into abutment against each other.

DESCRIPTION OF EMBODIMENT

Figure 1:
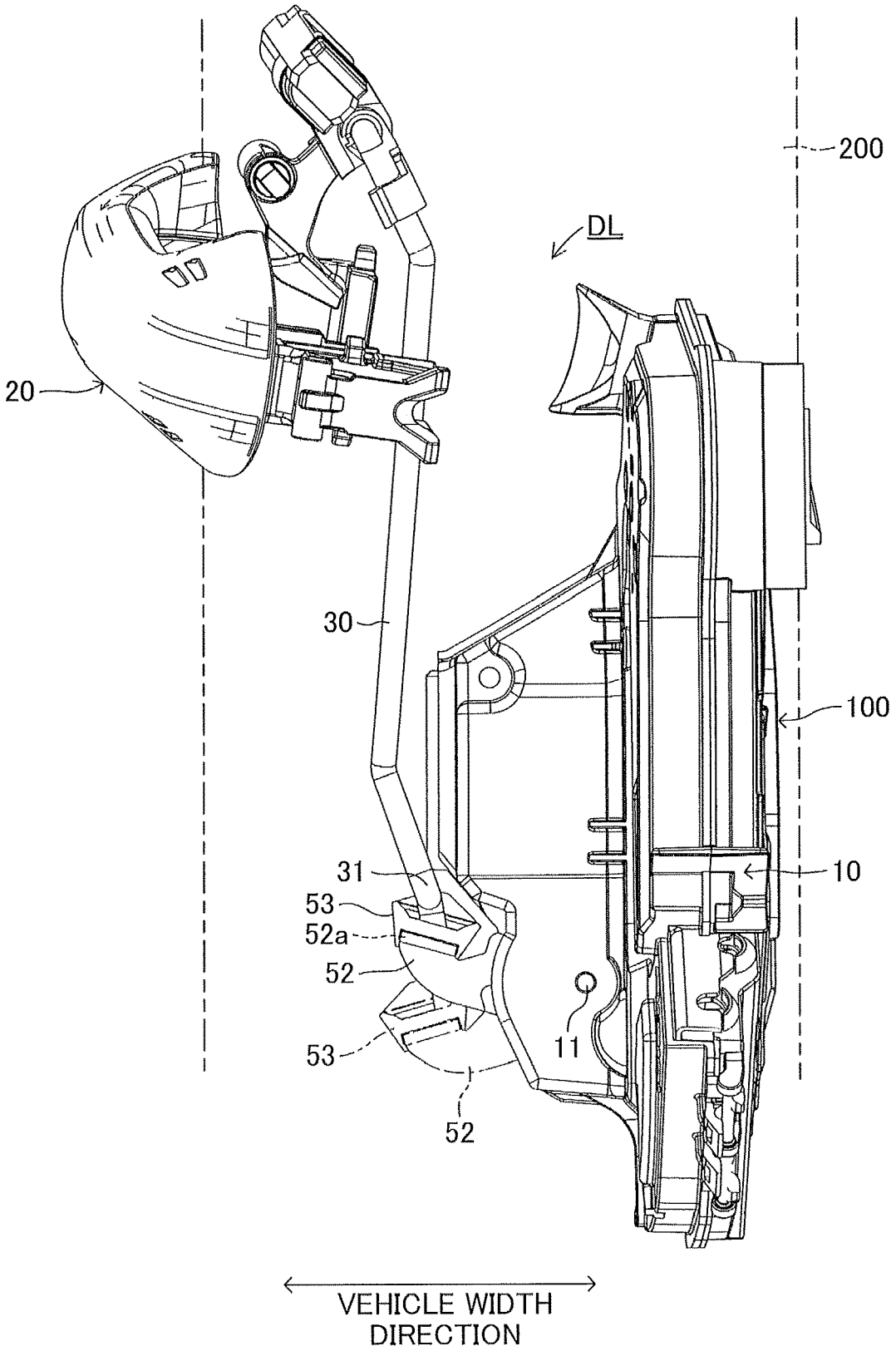
FIG. 1 is a rear view of a vehicle door lock device according to an embodiment of the present invention as seen from a rear side of a vehicle.

Now, an embodiment of the present invention is described with reference to the drawings. FIG. 1 illustrates a vehicle door lock device DL according to the present invention. The vehicle door lock device DL is mounted to a door 200 (see the imaginary lines of FIG. 1) to be installed at a front right side of a vehicle. The vehicle door lock device DL includes a door lock body 100 configured to be mounted to the door 200, an outside open lever 52 mounted, in a pivotable (swingable) manner, to a support shaft 11 arranged on the door lock body 100, a clip (coupling member) 53 integrally mounted to a tongue-like mounting portion 52*a* formed at a pivot end portion of the outside open lever 52, an outside door handle 20 configured to be mounted to a vehicle exterior side of the door 200, and a rod 30 coupled to each of the clip 53 and the outside door handle 20.

Figure 2:
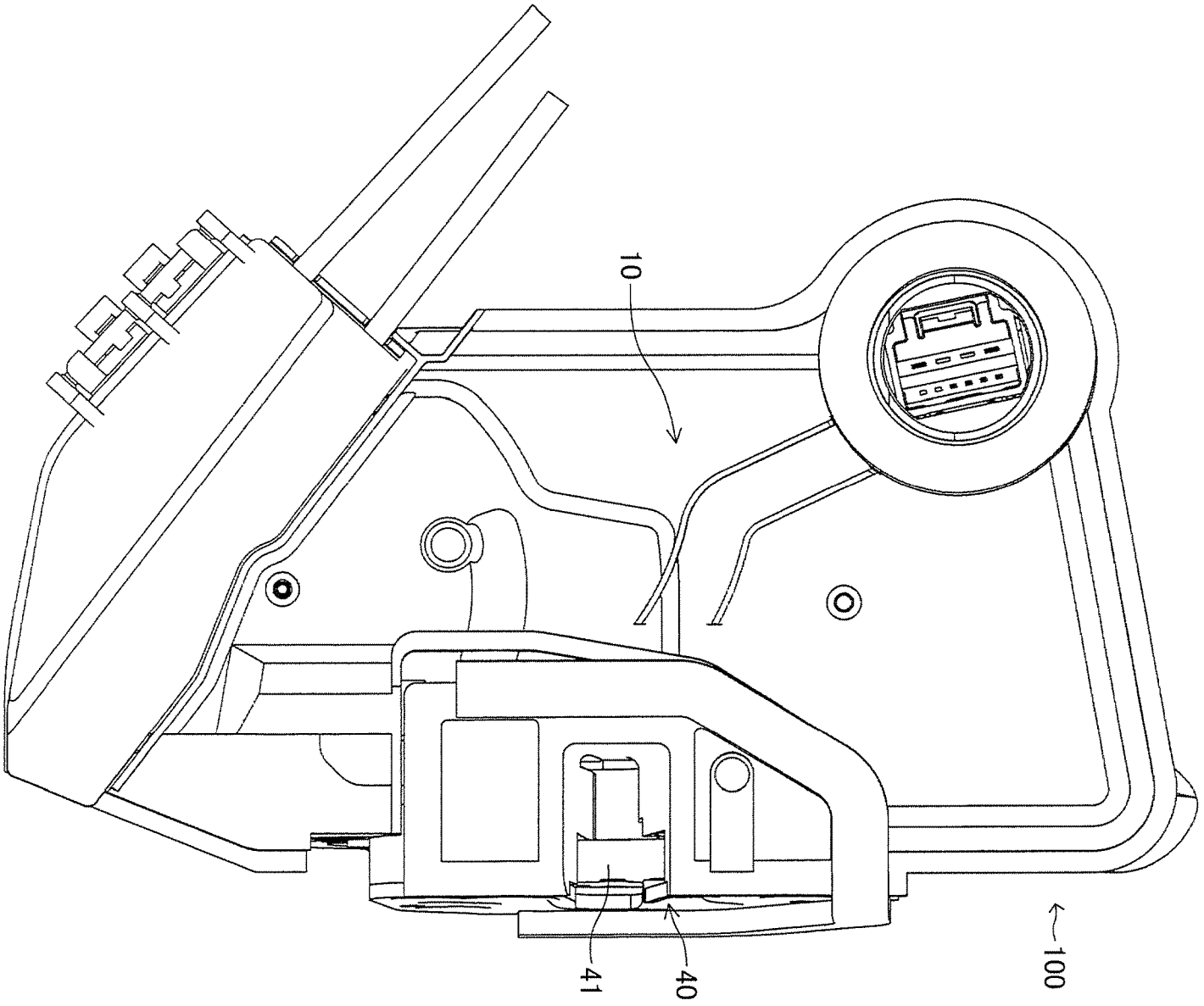
FIG. 2 is a side view of a door lock body of the vehicle door lock device illustrated in FIG. 1 as seen from an inner side of a vehicle cabin.
Figure 3:
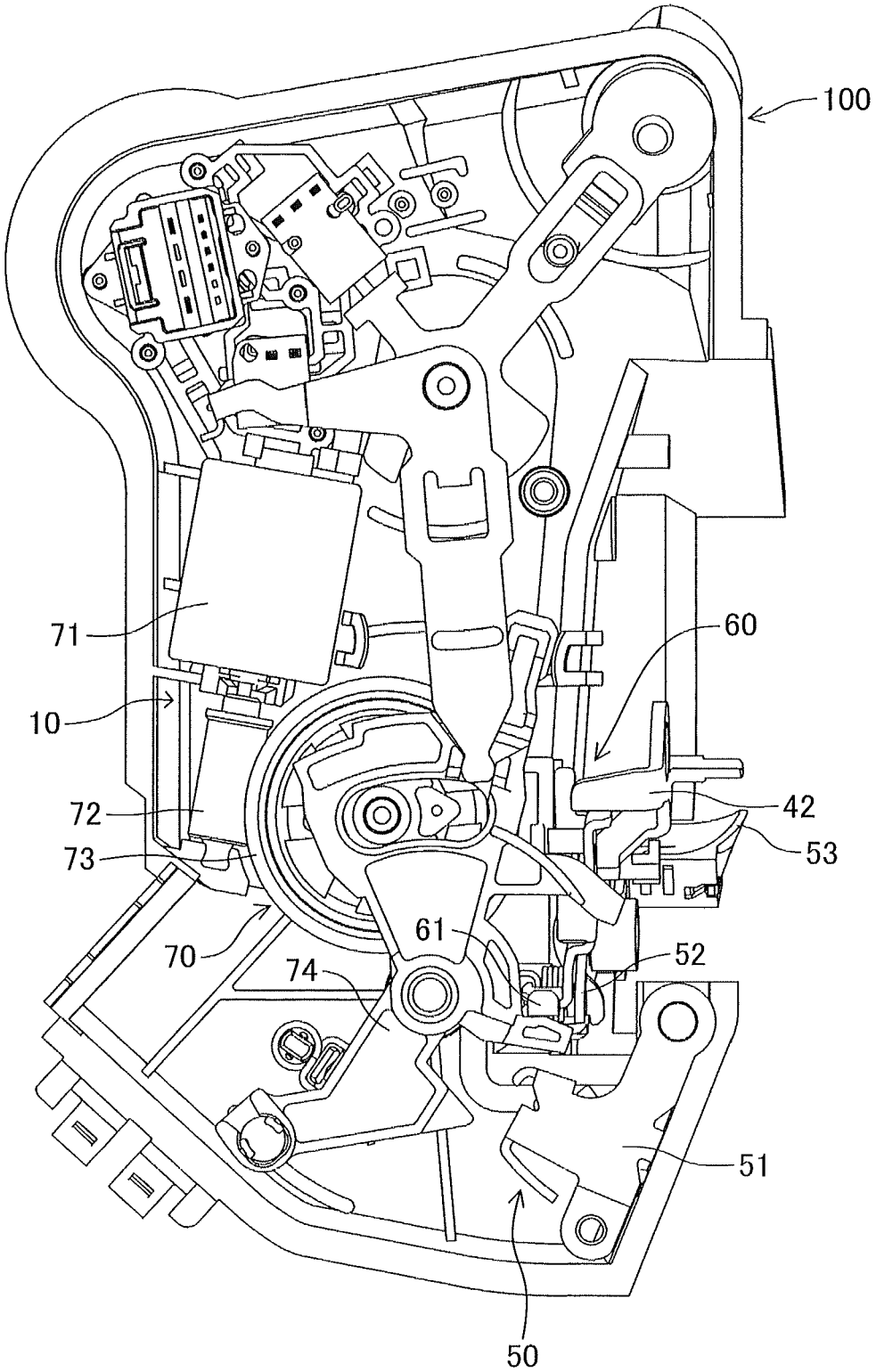
FIG. 3 is a view illustrating the structure inside a housing of the door lock body illustrated in FIG. 2.
Figure 4:
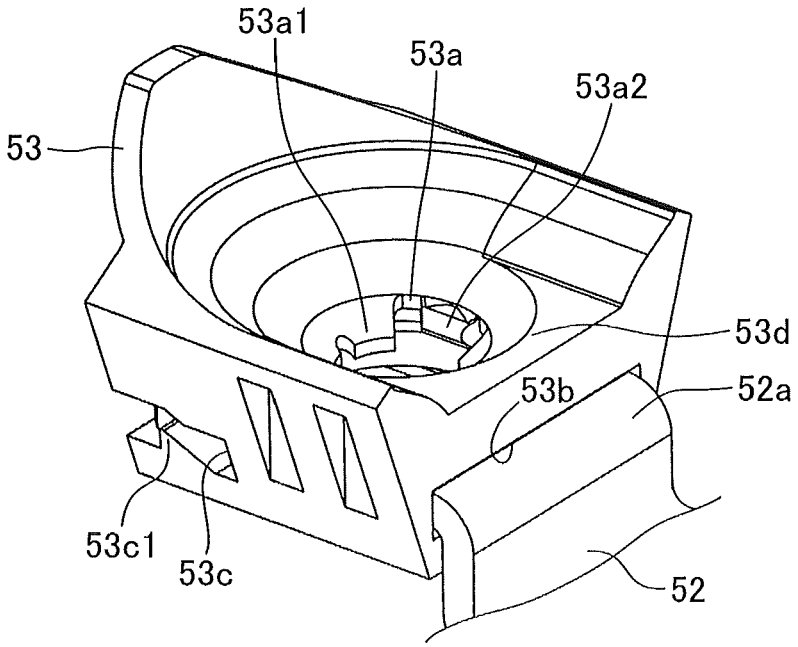
FIG. 4 is a perspective view illustrating a relationship between a clip (coupling member) and an outside open lever illustrated in FIG. 1.
Figure 5:
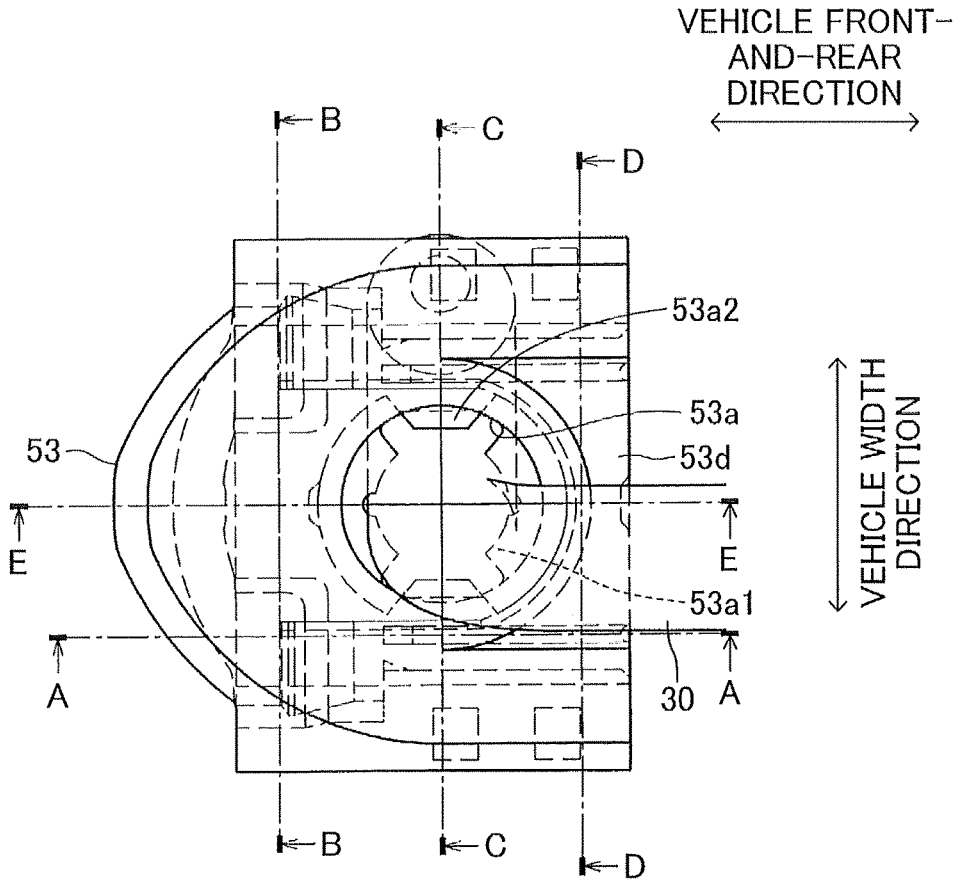
FIG. 5 is a plan view illustrating a relationship between the clip and a rod illustrated in FIG. 1.

As illustrated in FIGS. 1 to 3, the door lock body 100 includes a housing 10 mounted to the inside of the door 200, and a latch mechanism 40, a lever mechanism 50, a link mechanism 60, and an electric actuator 70, which are assembled to the housing 10. As is well known, the latch mechanism 40 is configured to retain the door 200 on a body (vehicle body (not shown)) in a closed state (state in which the door 200 is closed). The latch mechanism 40 includes a latch 41 engageable with and disengageable from a striker (not shown) fixed to the body (not shown).

The lever mechanism 50 includes an inside open lever 51 mounted to the housing 10 and configured to be driven along with an operation of an inside door handle (not shown) arranged at an inner side of the door 200, and the outside open lever 52 mounted to the housing 10 through intermediation of the support shaft 11 and configured to be driven along with an operation of the outside door handle 20 arranged at an outer side of the door 200. Note that, the support shaft 11 is arranged so as to extend in a vehicle front-and-rear direction under a state in which the door 200 is closed.

The link mechanism 60 is interposed between the latch mechanism 40 and the lever mechanism 50 inside the housing 10. The link mechanism 60 includes an open link 61 switchable between an unlock state for enabling operation force transmission from the lever mechanism 50 to the latch mechanism 40 and a lock state for disabling the operation force transmission. The open link 61 is interposed between each of the inside open lever 51 and the outside open lever 52 of the lever mechanism 50 and a lift lever 42 of the latch mechanism 40, and is switchable between an unlock position for transmitting, to the lift lever 42, actuation of each of the open levers 51 and 52 in a door opening direction along with the door opening operation of each of the door handles (20) (for enabling the operation force transmission) and a lock position for avoiding the transmission of the actuation to the lift lever 42 (for disabling the operation force transmission).

The electric actuator 70 is mounted to the inside of the housing 10, and is capable of switching the link mechanism 60 between the unlock state and the lock state. The electric actuator 70 includes an electric motor 71, a worm 72, and a worm wheel 73, and further includes an active lever 74 to be driven by those components. Note that, the active lever 74 is coupled to a lock knob (not shown) arranged on the door 200 at the inner side of the vehicle, thereby being drivable also through a manual operation of the lock knob (not shown). Further, the active lever 74 is also coupled to a key cylinder (not shown) arranged at the outer side of the door 200, thereby being drivable also through a manual operation of the key cylinder (not shown).

Incidentally, in this embodiment, the outside open lever 52 made of a metal plate (iron plate), the clip 53 made of a synthetic resin, and the rod 30 made of a metal (iron) are assembled to each other as illustrated in FIGS. 4 to 13. The outside open lever 52 is mounted to the support shaft 11 in a pivotable manner so that the tongue-like mounting portion 52*a* formed at the pivot end portion is movable in an up-and-down direction between a home position indicated by the solid line of FIG. 1 and an actuation position indicated by the imaginary line of FIG. 1. The mounting portion 52*a* is formed so as to bend in an extending direction of the support shaft 11 (vehicle front-and-rear direction). The mounting portion 52*a* has a through hole 52*a*1 (see FIGS. 10 and 13) that allows the rod 30 to be inserted therethrough and tilted thereinside, and a pair of cutouts 52*a*2 (see FIGS. 8 and 13) configured to prevent the clip 53 from being slipped off.

The clip 53 is fitted and fixed onto the mounting portion 52*a* of the outside open lever 52 through insertion of the clip 53 along an extending direction of the mounting portion 52*a* (vehicle front-and-rear direction). The clip 53 has an insertion hole 53*a* that allows the rod 30 to be inserted therethrough in the vehicle up-and-down direction and tilted thereinside in the vehicle right-and-left direction (vehicle width direction) under the state of FIG. 1 (state in which the door 200 is closed), and a mounting hole 53*b* formed so as to be orthogonal to the insertion hole 53*a*. Therefore, the clip 53 is fitted and fixed onto the mounting portion 52*a* of the outside open lever 52 through the mounting hole 53*b* of the clip 53.

The insertion hole 53*a* is formed into a circular shape, and a pair of front and rear first extended portions 53*a*1 and a pair of right and left second extended portions 53*a*2 are formed on an inner circumferential wall (inner surface) of the insertion hole 53*a*. The first extended portions 53*a*1 are each configured to retain a crank portion 31, which is formed at a distal end portion of the rod 30 (end portion on the coupling member side (also on the outside open lever side)), in a state in which the crank portion 31 is easily movable in an axial direction of the support shaft 11 (vehicle front-and-rear direction). The first extended portions 53*a*1 are arranged so as to be opposed to each other, and are each formed into a circular-arc fin shape (thin shape), in which a distal end portion thereof is easily deflectable (see FIGS. 5 and 12). On the other hand, the second extended portions 53*a*2 are each configured to retain the crank portion 31 of the rod 30 in a state in which the crank portion 31 is not easily movable in a horizontal direction (vehicle width direction) orthogonal to the axial direction of the support shaft 11. The second extended portions 53*a*2 are arranged so as to be opposed to each other, and are each formed into a circular-arc block shape (shape in which the thickness of the second extended portion 53*a*2 is set larger than the thickness of the first extended portion 53*a*1) (see FIGS. 5 and 10).

Figure 10:
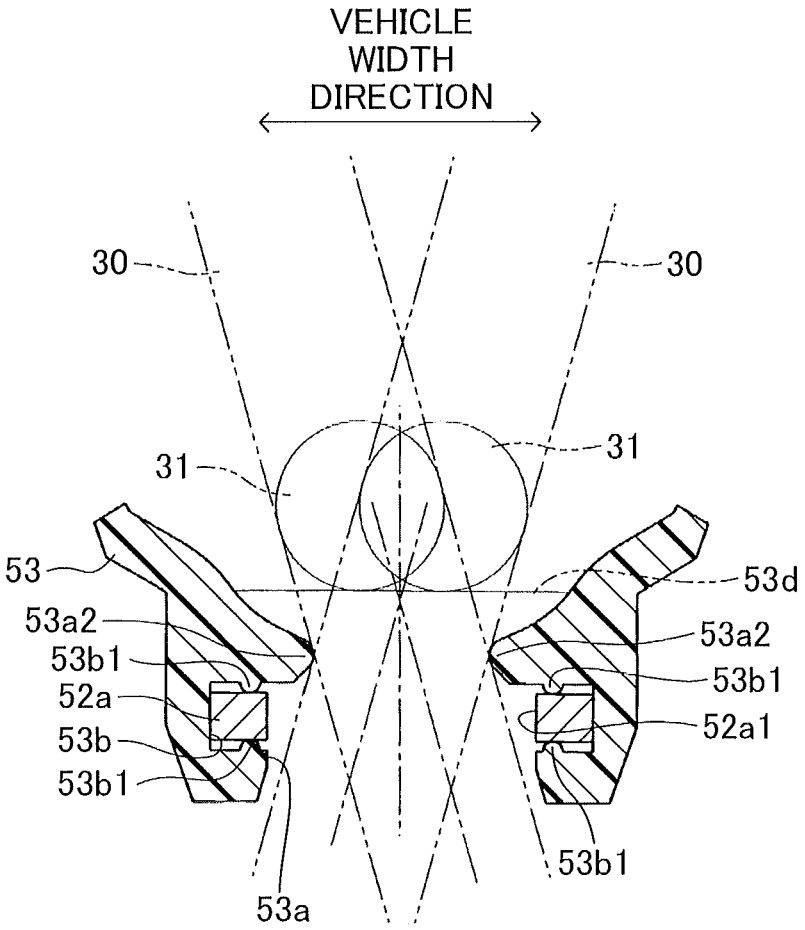
FIG. 10 is a vertical end view of the clip, the outside open lever, and the rod taken along the line C-C of FIG. 5.
Figure 11:
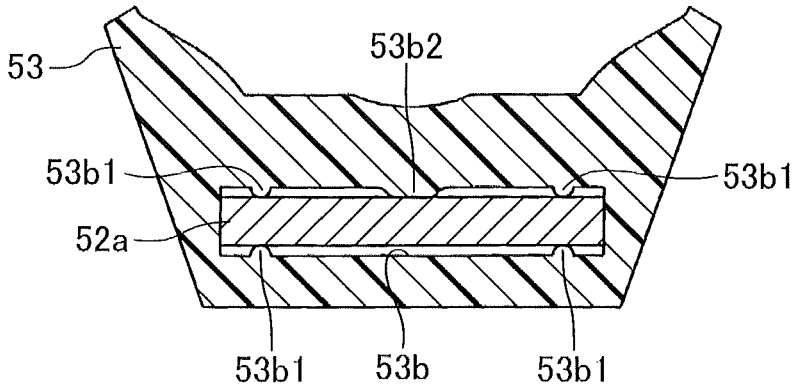
FIG. 11 is a vertical end view of the clip and the outside open lever taken along the line D-D of FIG. 5.
Figure 12:
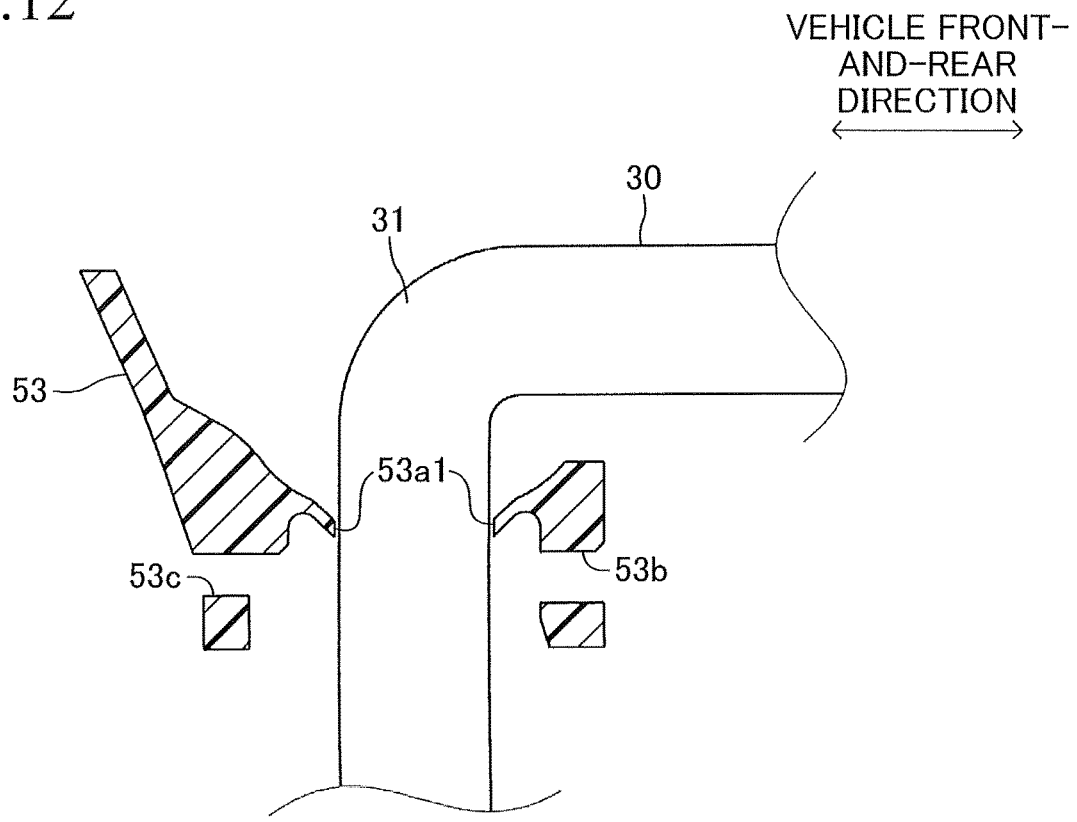
FIG. 12 is a vertical end view of the clip and the rod taken along the line E-E of FIG. 5.

As illustrated in FIG. 11, the mounting hole 53*b* is formed into a rectangular shape in cross section, and four threads of upper and lower protrusions 53*b*1 arranged in two pairs, one thread of protrusion 53*b*2, two right and left protrusions 53*b*3 arranged in pairs, and one protrusion 53*b*4 are formed on an inner wall of the mounting hole 53*b* (see FIGS. 6, 8, 10, 11, and 13). As illustrated in FIGS. 10 and 11, the protrusions 53*b*1 are each configured to retain the mounting portion 52*a* of the outside open lever 52 in the vehicle up-and-down direction without a gap. The protrusions 53*b*1 are each formed into a straight-line shape along the vehicle front-and-rear direction, and are engaged with upper and lower surfaces of the mounting portion 52*a* of the outside open lever 52 without a gap. As illustrated in FIG. 11, the protrusion 53*b*2 is configured to be engaged with the upper surface of the mounting portion 52*a* of the outside open lever 52 without a gap, and is formed into a straight-line shape along the vehicle front-and-rear direction.

Figure 13:
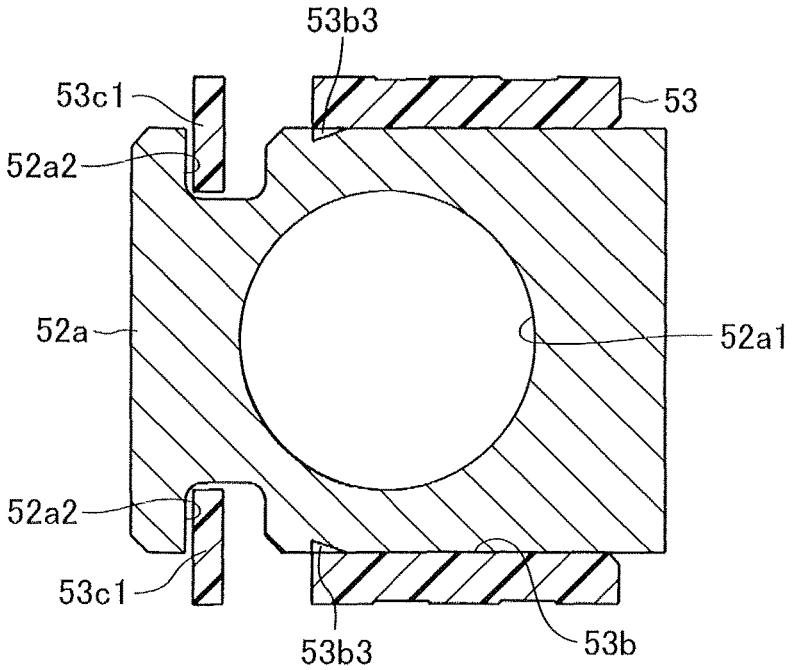
FIG. 13 is a horizontal end view of the clip and the outside open lever taken along the line F-F of FIG. 6.

The protrusions 53*b*3 are each configured to be engaged with an end surface of the mounting portion 52*a* of the outside open lever 52 in the vehicle width direction without a gap, to thereby retain the mounting portion 52*a* of the outside open lever 52 in the vehicle width direction without a gap. Under a free state (state in which the clip 53 is not mounted to the mounting portion 52*a* of the outside open lever 52), the protrusions 53*b*3 are each formed into a wedge shape as illustrated in FIG. 13. The protrusion 53*b*4 is configured to be engaged with the lower surface of the mounting portion 52*a* of the outside open lever 52 without a gap, to thereby retain the mounting portion 52*a* of the outside open lever 52 in the vehicle up-and-down direction without a gap. Under the free state (state in which the clip 53 is not mounted to the mounting portion 52*a* of the outside open lever 52), the protrusion 53*b*4 is formed into a wedge shape as illustrated in FIG. 8.

Further, the clip 53 has a cutout (slit) 53*c* formed so as to correspond to the mounting hole 53*b*. The cutout 53*c* is configured such that a part of the mounting portion 52*a* of the outside open lever 52 (distal end portion having the pair of cutouts 52*a*2) is inserted therethrough. A pair of protrusions 53*c*1 and one thread of protrusion 53*c*2 are formed on an inner wall of the cutout 53*c*. The protrusion 53*c*2 corresponds to a first protrusion, which is configured to be engaged with the upper surface of the mounting portion 52*a* of the outside open lever 52 without a gap, and is formed into a straight-line shape along the vehicle front-and-rear direction (see FIGS. 6 and 9).

Figure 6:
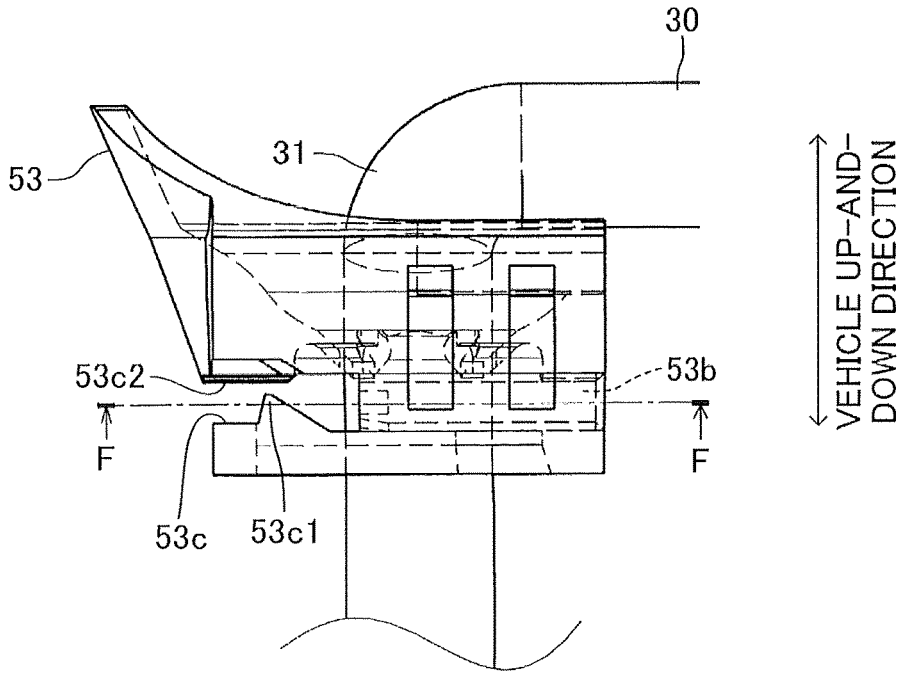
FIG. 6 is a side view illustrating the relationship between the clip and the rod illustrated in FIG. 1.
Figure 7:
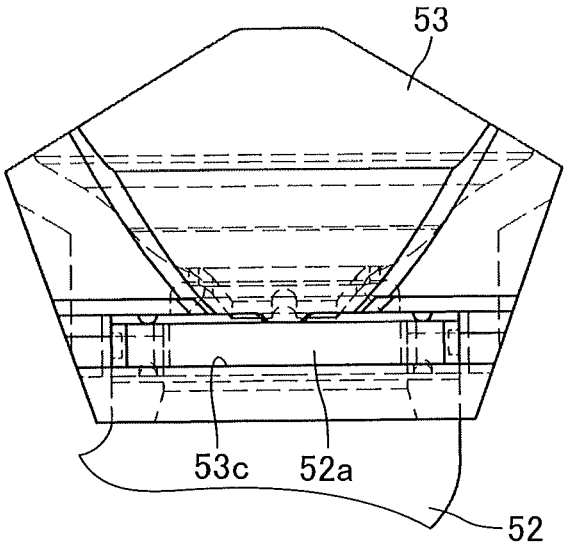
FIG. 7 is a front view illustrating the relationship between the clip and the outside open lever illustrated in FIG. 1.
Figure 8:
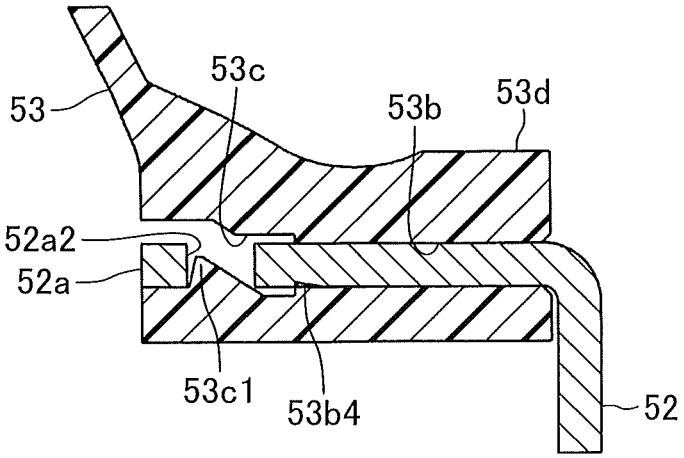
FIG. 8 is a vertical end view of the clip and the outside open lever taken along the line A-A of FIG. 5.
Figure 9:
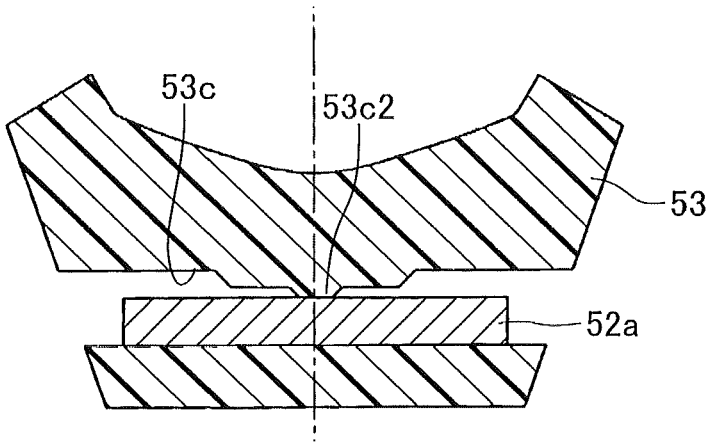
FIG. 9 is a vertical end view of the clip and the outside open lever taken along the line B-B of FIG. 5.

The protrusions 53*c*1 each correspond to a second protrusion, which is configured to be fitted into the cutout 52*a*2 formed in the mounting portion 52*a* of the outside open lever 52 under a state in which the clip 53 is mounted to the outside open lever 52, to thereby prevent the clip 53 from being slipped off the mounting portion 52*a* of the outside open lever 52, and is formed into a wedge shape (see FIGS. 6, 8, and 13). Further, the protrusions 53*c*1 are each formed into a shape including a gentle slope at the mounting hole 53*b* side (right side of FIG. 6) and a steep slope at the opposite side (left side of FIG. 6), to thereby allow fitting between the mounting hole 53*b* of the clip 53 and the mounting portion 52*a* of the outside open lever 52 in one direction (forward direction), and to restrict fitting therebetween in another direction (reverse direction).

Thus, when the clip 53 is fitted onto the mounting portion 52*a* of the outside open lever 52 in the forward direction so as to be mounted thereto, the distal end surface of the mounting portion 52*a* of the outside open lever 52 is brought into abutment against the gentle slope portions of the protrusions 53*c*1 of the clip 53, to thereby allow the mounting (fitting) of the clip 53 to the mounting portion 52*a* of the outside open lever 52. At this time, the portions of the clip 53 where the protrusions 53*c*1 are formed (deflection portions at the protrusions 53*c*1) are deflected in a direction of opening the cutout 53*c* (downward direction of FIG. 6), to thereby allow the insertion of the part of the mounting portion 52*a* of the outside open lever 52 (distal end portion having the pair of cutouts 52*a*2) through the cutout 53*c* of the clip 53.

Further, when the clip 53 is mounted to the mounting portion 52*a* of the outside open lever 52 in the reverse direction, the distal end surface of the mounting portion 52*a* of the outside open lever 52 is brought into abutment against the steep slope portions of the protrusions 53*c*1 of the clip 53, to thereby inhibit the mounting (fitting) of the clip 53 to the mounting portion 52*a* of the outside open lever 52. Therefore, the protrusions 53*c*1 each function to prevent the clip 53 from being slipped off, and also to prevent the clip 53 from being mounted erroneously.

Further, the clip 53 has an abutment surface 53*d* formed so as to overlap with the mounting hole 53*b*. The abutment surface 53*d* is a portion configured to receive a downward force applied to the rod 30 (portion capable of transmitting motion of the rod 30 to the outside open lever 52), and is formed in abutment against a part of the crank portion 31 formed at the distal end portion of the rod 30. Further, the abutment surface 53*d* is arranged in proximity to the distal end portions of the second extended portions 53*a*2 in the up-and-down direction relative to the distal end portions of the first extended portions 53*a*1.

Note that, when the mounting portion 52*a* of the outside open lever 52 is located at the home position indicated by the solid line of FIG. 1, the rod 30 is located at an initial abutment position indicated by the imaginary line of FIG. 10 so that a part of the crank portion 31 is brought into abutment against the abutment surface 53*d*. When the mounting portion 52*a* of the outside open lever 52 is located at the actuation position indicated by the imaginary line of FIG. 1, the rod 30 is located at a full stroke position indicated by the imaginary line of FIG. 10 so that a part of the crank portion 31 is brought into abutment against the abutment surface 53*d*. Therefore, when the rod 30 is moved between the initial abutment position and the full stroke position, the rod 30 is tilted in the vehicle width direction under a state in which the rod 30 is retained by the pair of second extended portions 53*a*2.

In the embodiment constructed as described above, the first extended portions 53*a*1 each configured to retain the crank portion 31 of the rod 30 in the state in which the crank portion 31 is easily movable in the axial direction of the support shaft 11 and the second extended portions 53*a*2 each configured to retain the crank portion 31 of the rod 30 in the state in which the crank portion 31 is not easily movable in the horizontal direction orthogonal to the axial direction of the support shaft 11 are formed in the insertion hole 53*a* of the clip 53. Therefore, the mobility is maintained at the coupling point between the crank portion 31 of the rod 30 and the clip 53 by the first extended portions 53*a*1. Further, the rod 30 is definitely positioned relative to the clip 53 by the second extended portions 53*a*2, with the result that the operation amount (opening stroke) of the outside door handle 20 is stabilized.

Further, in this embodiment, when the motion (up-and-down motion) of the rod 30 is transmitted to the outside open lever 52 via the clip 53, the motion of the rod 30 in the horizontal direction is restricted by the second extended portions 53*a*2 of the clip 53. Therefore, the load is appropriately transmitted from the rod 30 to the outside open lever 52, with the result that satisfactory operation feeling is attained.

Further, in this embodiment, the first extended portions 53*a*1 are each formed on the clip 53 into the fin shape (thin shape), whereas the second extended portions 53*a*2 are each formed on the clip 53 into the block shape (shape in which the thickness of the second extended portion 53*a*2 is larger than the thickness of the first extended portion 53*a*1). Thus, as compared to the extended portions each formed into the fin shape, there is no such risk that the second extended portions 53*a*2 each formed into the block shape are deformed over a long-term use (repeated operation). Therefore, the operation amount (opening stroke) of the outside door handle 20 is stabilized even over the long-term use (repeated operation). Further, increase in size of the gap between the clip 53 and the rod 30 can be suppressed even over the long-term use (repeated operation), thereby being capable of eliminating the risk of abnormal noise.

Further, in this embodiment, the clip 53 has the abutment surface 53*d* capable of transmitting the motion of the rod 30 (in the up-and-down direction) to the outside open lever 52, and the distal end portions of the second extended portions 53*a*2 are arranged in proximity to the abutment surface 53*d* relative to the distal end portions of the first extended portions 53*a*1. Therefore, as compared to a case where the distal end portions of the first extended portions 53*a*1 are arranged in proximity to the abutment surface 53*d* relative to the distal end portions of the second extended portions 53*a*2, the position where the rod 30 is retained during the operation of the outside door handle 20 can be set definitely. Also with this structure, the operation feeling can be improved.

Further, in the embodiment constructed as described above, the mounting hole 53*b* orthogonal to the insertion hole 53*a* is formed in the clip 53, and the tongue-like mounting portion 52*a* is formed at the pivot end portion of the outside open lever 52. The clip 53 is fitted and fixed onto the mounting portion 52*a* of the outside open lever 52 through the mounting hole 53*b*. Therefore, the direction of mounting (fitting) the clip 53 to the outside open lever 52 is perpendicular to the direction of inserting (introducing) the rod 30 through the insertion hole 53*a* of the clip 53.

Thus, the protrusions 53*c*1 formed on the clip 53 (protrusions configured to exert the slip-off preventing function) protrude in an axial direction of the insertion hole 53*a* of the clip 53. Therefore, under the state in which the clip 53 is mounted to the outside open lever 52, even when the rod 30 is inserted through the insertion hole 53*a* of the clip 53 and an end portion of the clip 53 is pressed by the rod 30 in a radial direction of the insertion hole 53*a*, the protrusions 53*c*1 are not easily disengaged, with the result that the clip 53 is not easily detached from the outside open lever 52.

Further, in this embodiment, the amount of fitting between the mounting portion 52*a* of the outside open lever 52 (formed into the tongue shape whose length may be set as appropriate) and the mounting hole 53*b* of the clip 53 is secured sufficiently, thereby being capable of securing a sufficient length for each of the deflection portions at the protrusions 53*c*1 formed on the clip 53. Thus, the mountability for the clip 53 to be mounted to the outside open lever 52 can be attained satisfactorily. Accordingly, it is possible to secure both of a necessary and sufficient retention force (engagement force) for the clip 53 to be mounted to the outside open lever 52 and satisfactory mountability for the clip 53 to be mounted to the outside open lever 52.

Further, in this embodiment, the protrusions 53*b*1 and 53*b*2 each configured to be engaged with the mounting portion 52*a* of the outside open lever 52 without a gap are formed on the inner wall of the mounting hole 53*b* of the clip 53. Therefore, the gap generated between the mounting portion 52*a* of the outside open lever 52 and the mounting hole 53*b* of the clip 53 can be eliminated by the protrusions 53*b*1 and 53*b*2, thereby being capable of eliminating looseness of the clip 53 from the outside open lever 52. Note that, the shapes and the numbers of the protrusions 53*b*1 and 53*b*2 may be changed as appropriate.

Further, in this embodiment, the wedge-like protrusions 53*c*1 are formed on the clip 53 so as to correspond to the mounting hole 53*b* of the clip 53, to thereby allow the fitting between the mounting hole 53*b* of the clip 53 and the mounting portion 52*a* of the outside open lever 52 in one direction, and to restrict the fitting therebetween in another direction. Therefore, the wedge-like protrusions 53*c*1 are capable of functioning to prevent the clip 53 from being slipped off, and also to prevent the clip 53 from being mounted erroneously. Note that, the shape and the number of the wedge-like protrusions 53*c*1 may be changed as appropriate.

In the above-mentioned embodiment, the present invention is carried out so that the numbers of the first extended portions 53*a*1 and the second extended portions 53*a*2 formed on the clip 53 are set to two, respectively. However, the numbers of the first extended portions 53*a*1 and the second extended portions 53*a*2 may be increased or decreased as appropriate, and are not limited to those of the above-mentioned embodiment. Further, in the above-mentioned embodiment, the present invention is carried out so that the first extended portions 53*a*1 configured to retain the crank portion 31 of the rod 30 in the state in which the crank portion 31 is easily movable in the axial direction of the support shaft 11 are each formed into the circular-arc fin shape, and that the second extended portions 53*a*2 configured to retain the crank portion 31 of the rod 30 in the state in which the crank portion 31 is not easily movable in the horizontal direction orthogonal to the axial direction of the support shaft 11 are each formed into the circular-arc block shape. However, the shapes of the first extended portions 53*a*1 and the second extended portions 53*a*2 may be changed as appropriate, and are not limited to those of the above-mentioned embodiment.

Further, in the above-mentioned embodiment, the mounting hole 53*b* of the clip 53 is formed so as to be orthogonal to the insertion hole 53*a*, but the present invention may be carried out so that the mounting hole 53*b* of the clip 53 is formed so as to intersect the insertion hole 53*a*. Further, in the above-mentioned embodiment, the present invention is carried out so that the mounting portion 52*a* arranged at the pivot end portion of the outside open lever 52 is formed into the tongue shape, but the shape of the mounting portion 52*a* may be changed as appropriate, and is not limited to that of the above-mentioned embodiment. Further, in the above-mentioned embodiment, the present invention is carried out so that the protrusions 53*c*1 arranged on the clip 53 are each formed into the wedge shape, but the shape of the protrusions 53*c*1 may be changed as appropriate, and is not limited to that of the above-mentioned embodiment.

The invention claimed is:

1. A vehicle door lock device, comprising:

a door lock body configured to be mounted to a door of a vehicle;

an outside open lever mounted, in a pivotable manner, to a support shaft arranged on the door lock body;

a coupling member mounted to a pivot end portion of the outside open lever, the coupling member having an insertion hole through which an end portion of a rod on the outside open lever side is inserted, the rod being configured to couple the outside open lever and an outside door handle configured to be mounted to a vehicle exterior side of the door;

a mounting hole formed in the coupling member so as to intersect the insertion hole; and a mounting portion formed at the pivot end portion of the outside open lever and fitted into the mounting hole, wherein the coupling member includes a protrusion which is formed on the coupling member so as to correspond to the mounting hole and protrudes in a protrusion direction parallel and opposite to an extending direction of the end portion of the rod, the coupling member is fixed, via the protrusion, to the mounting portion fitted into the mounting hole, and the protrusion is spaced apart from the rod, protrudes within a cutout defined in the mounting portion, and is configured to allow fitting between the mounting hole of the coupling member and the mounting portion of the outside open lever in one direction, and to restrict fitting between the mounting hole of the coupling member and the mounting portion of the outside open lever in an other direction parallel and opposite to the one direction, the one direction and the other direction being perpendicular to the protrusion direction and the extending direction.

2. A vehicle door lock device according to claim 1, wherein the protrusion is a second protrusion, and the vehicle door lock device further comprises a first protrusion formed on an inner wall of the mounting hole and configured to be engaged with the mounting portion of the outside open lever without a gap.

3. A vehicle door lock device according to claim 1, wherein the protrusion comprises a first slope portion and a second slope portion, the second slope portion being steeper than the first slope portion, wherein the fitting in the one direction is allowed when the first slope portion and the mounting portion are brought into abutment against each other, and wherein the fitting in the other direction is restricted when the second slope portion and the mounting portion are brought into abutment against each other.

4. A vehicle door lock device, comprising:

a door lock body configured to be mounted to a door of a vehicle;

an outside open lever mounted, in a pivotable manner, to a support shaft arranged on the door lock body;

a coupling member being mounted to a pivot end portion of the outside open lever and having an insertion hole;

an outside door handle configured to be mounted to a vehicle exterior side of the door;

a rod being coupled to each of the coupling member and the outside door handle and having an end portion on the coupling member side inserted through the insertion hole;

a mounting hole formed in the coupling member so as to intersect the insertion hole; and a mounting portion formed at the pivot end portion of the outside open lever and fitted into the mounting hole, wherein the coupling member includes a protrusion which is formed on the coupling member so as to correspond to the mounting hole and protrudes in a protrusion direction parallel and opposite to an extending direction of the end portion of the rod, the coupling member is fixed, via the protrusion, to the mounting portion fitted into the mounting hole, and the protrusion is spaced apart from the rod, protrudes within a cutout defined in the mounting portion, and is configured to allow fitting between the mounting hole of the coupling member and the mounting portion of the outside open lever in one direction, and to restrict fitting between the mounting hole of the coupling member and the mounting portion of the outside open lever in an other direction parallel and opposite to the one direction, the one direction and the other direction being perpendicular to the protrusion direction and the extending direction.

5. A vehicle door lock device according to claim 1, further comprising:

a first extended portion formed on an inner surface of the insertion hole of the coupling member and configured to retain the end portion of the rod on the outside open lever side in a state in which the end portion is easily movable in an axial direction of the support shaft; and a second extended portion formed on the inner surface of the insertion hole of the coupling member and configured to retain the end portion of the rod on the outside open lever side in a state in which the end portion is not easily movable in a horizontal direction orthogonal to the axial direction.

6. A vehicle door lock device according to claim 5, wherein a thickness of the second extended portion is set larger than a thickness of the first extended portion.

7. A vehicle door lock device according to claim 5, wherein the coupling member has an abutment surface capable of transmitting motion of the rod to the outside open lever, and wherein a distal end portion of the second extended portion is arranged in proximity to the abutment surface relative to a distal end portion of the first extended portion.

8. A vehicle door lock device according to claim 4, further comprising:

a first extended portion formed in the insertion hole of the coupling member and configured to retain the end portion of the rod on the coupling member side in a state in which the end portion is easily movable in an axial direction of the support shaft; and a second extended portion formed in the insertion hole of the coupling member and configured to retain the end portion of the rod on the coupling member side in a state in which the end portion is not easily movable in a horizontal direction orthogonal to the axial direction.

* * * * *